US005921286A

United States Patent [19]

Wahhoud et al.

[11] Patent Number: 5,921,286

[45] Date of Patent: Jul. 13, 1999

[54] LENO DEVICE WITH A THREAD GUIDE EYELET

[75] Inventors: Adnan Wahhoud, Lindau-Bodolz; Hans-Dieter Scorl, Lindau; Peter Czura, Wangen, all of Germany; Josef Hehle, Hoerbranz, Austria

[73] Assignee: Lindauer Dornier Gesellschaft mbH, Lindau, Germany

[21] Appl. No.: 08/963,557

[22] Filed: Nov. 3, 1997

[30] Foreign Application Priority Data

Nov. 8, 1996 [DE] Germany ..... 196 46 136

[51] Int. Cl.[6] ..... D03C 7/04

[52] U.S. Cl. ..... 139/54; 139/50

[58] Field of Search ..... 139/54, 50; 242/157.1

[56] References Cited

U.S. PATENT DOCUMENTS

| | | | |
|---|---|---|---|
| 1,055,191 | 3/1913 | Ledoux et al. | 139/54 |
| 3,981,331 | 9/1976 | Camprubi | 139/54 |
| 3,998,247 | 12/1976 | Kovar | 139/54 |
| 4,043,623 | 8/1977 | Rausch et al. | 308/238 |
| 4,103,716 | 8/1978 | Cornellier . | |
| 5,518,039 | 5/1996 | Haeussler et al. | 139/54 |
| 5,524,678 | 6/1996 | Haeussler et al. . | |

FOREIGN PATENT DOCUMENTS

| | | |
|---|---|---|
| 192982 | 6/1906 | Germany . |
| 2129817 | 12/1971 | Germany . |
| 2134361 | 3/1972 | Germany . |
| 2423454 | 4/1975 | Germany . |
| 2515961 | 1/1976 | Germany . |
| 268815 | 6/1950 | Switzerland . |

*Primary Examiner*—Andy Falik
*Attorney, Agent, or Firm*—W. F. Fasse; W. G. Fasse

[57] ABSTRACT

A thread guide formed as a guide eyelet especially for a leno disk has an entrance with an opening angle (α) and an exit with an opening angle (β). The entrance and exit are interconnected by a guide bore or hole (6) surrounded by a curved bore ring surface or bead (9). The entrance and exit each have a recess (4, 5) surrounded by a respective rim portion (7, 8) of a rim surrounding the thread guide eyelet (2A, 2B). Each rim portion (7, 8) has an edge with a curved ring surface (R1 and/or R3) surrounding the respective entrance (10) and exit (11). The entrance and exit curved ring surfaces are spaced from the bore ring surface or bead (9) so that a thread passing through the thread guide has a small surface area contact with these curved ring surfaces to reduce friction while providing a positive guidance for the thread.

21 Claims, 2 Drawing Sheets

LENO DEVICE WITH A THREAD GUIDE EYELET

FIELD OF THE INVENTION

The invention relates to an eyelet for guiding a thread in a loom especially an eyelet for a leno thread for forming a leno selvedge in a loom.

BACKGROUND INFORMATION

It is known from German Patent Publication D 2,423,454 (Riha et al.), published on Dec. 9, 1982, and from German Patent Publication DE 4,405,778 (Häussler et al.), published on Aug. 3, 1995, that a leno selvedge forming device also referred to a selvedge rotor is equipped with a leno disk that may be provided with a gear rim and is equipped with eyelets or rather with two thread guide channels positioned diametrically opposite each other and passing through the circular surface of the leno disk. Each of these eyelets or guide channels guide one leno thread. German Patent Publication D 4,405,778 corresponds in part to U.S. Pat. No. 5,524,678 (Häussler et al.).

For a proper leno selvedge formation it is necessary that each leno thread is detoured twice by about 90° on its way from the leno thread supply spool to the leno selvedge as the thread passes through the eyelet or guide channel of the leno disk. There is a problem especially in connection with the use of delicate leno threads because these threads tent to break when they are diverted by the leno disk.

From German Patent Publication DE 4,405,777 (Häussler et al.) also corresponding in part to U.S. Pat. No. 5,524,678 (Häussler et al.) it is known to provide the leno disk with eyelets for guiding the leno thread. However, in operation the leno disk performs a full revolution in one direction and again a full revolution in the opposite direction, whereby the leno thread is temporarily tensionless which can cause kinking of the thread at the moment of direction reversal of the leno disk rotation. Such kinking takes place at each edge of the eyelet namely at its entrance side and at its exit side. These features of the prior art leave room for improvement especially with regard to handling the leno threads more gently for reducing wear and tare not only of the leno threads but also of the leno disk itself particularly the thread guide eyelets in the leno disk.

It is known from U.S. Pat. No. 5,524,678 (Häussler et al.) and from German Patent Publication D 2,515,961 (Kovar) to treat the leno threads more gently by an elongated eyelet or eyelets in the leno disk or ring. While this solution provides a relatively gentle treatment of the leno thread, it does reduce the length of the leno stroke of the leno disk for the formation of the leno shed.

U.S. Pat. No. 4,103,716 (Cornellier) discloses a leno motion device with thread tensioning levers to take up the slack when the leno disk reverses directions.

German Patent Publication 2,134,361 (Svaty) published on Mar. 2, 1972 discloses an apparatus for applying a breaking action to a leno thread which travels through an eyelet formed by a wire.

The above discussed prior art leaves room for improvement especially with regard to the gentle treatment of delicate leno threads and with regard to providing the required guiding of the leno threads.

OBJECTS OF THE INVENTION

In view of the forgoing it is the aim of the invention to achieve the following objects singly or in combination:

- to provide a thread guide in the form of an eyelet that is particularly suitable for use in connection with a leno disk which will gently treat the leno thread and nevertheless positively guides the leno thread at all times on its way through the thread guide;
- to substantially reduce downtimes conventually caused by the breakage of a leno thread or threads in a loom;
- to impose a positive guidance on a thread especially a leno thread on its way through an entrance of a guide channel, in the guide channel, and on its way out of an exit of the guide channel; and
- to optimally reduce friction between the thread and surfaces of the thread guide.

SUMMARY OF THE INVENTION

The above objects have been achieved according to the invention by a thread guide which includes a disk surrounded by a rim with rim sections projecting axially in opposite axial directions from the disk. The rim sections surround respective recesses that face also in opposite axial directions so that a central disk portion is positioned between the recesses and surrounded by the rim. Each rim section has a curved ring surface and the disk itself is provided with a thread guide hole or bore passing through the disk, preferably centrally through the disk. The guide hole or bore is surrounded by an edge that is also provided with a curved ring surface. The curved ring surface of one rim section and a portion of the curved ring surface of the guide hole or bore form together an entrance into the thread guide. The entrance has an opening angle $\alpha$. The curved ring surface of the other rim section and another portion of the curved ring surface around the guide hole or bore form an exit out of the thread guide. The exit has an opening angle $\beta$. The recesses separate the curved ring surfaces at the entrance and exit from the respective curved ring surface portion of the guide hole or bore so that the surface area contact between these curved ring surfaces on the one hand and the thread passing through the guide on the other hand is optimally reduced whereby friction is also optimally reduced, yet a positive guide is achieved because two curved ring surfaces guide the thread with a spacing from each other when the thread enters the guide and two ring surfaces also spaced from each other guide the thread as it exits from the guide. An optimal reduction of friction is achieved when the required positive thread guidance is assured with a minimal surface area contact between the thread and the curved ring surfaces.

It is an advantage of the thread guide according to the invention that the threads especially leno threads, even very delicate leno threads, are gently yet positively guided through the leno disk. All types of threads, even brittle threads such as so-called glass silk threads, are gently yet positively guided by the present thread guide.

The recesses in the present guide disk or eyelets reduce the mass of the entire leno disk which improves the deceleration and acceleration for the reversal of the rotation direction of the leno disk.

Another advantage of the invention is seen that the present thread guide provides a circular guide which, compared to elongated guide slots of the prior art, avoids the above mentioned kinking problems. Thus, the invention combines the gentle guiding of the thread achieved by an elongated guide slot with the precision of a circular guide hole or channel. Such a circular guide hole avoids the above mentioned reduction in the stroke length of a leno disk for the formation of the leno shed.

Preferably the surfaces particularly the ring guide surfaces of the present thread guide are chromium hard plated to reduce wear and tear on the guide disk itself and to provide a smooth contact surface for the thread passing through the guide thereby also reducing wear and tear on the thread. In an alternative embodiment the guide disk or at least the ring surfaces are formed of ceramic material to provide the same friction reducing effects and wear resistance.

Yet another advantage of the invention is seen in that by preferably but not necessarily constructing the guide or eyelet as a component separate from the leno disk the guides are easily exchanged when it becomes necessary to repair or replace the thread guides in a leno disk while the leno disk itself does not require any repairs. The present thread guide may be secured to the leno disk by any suitable, conventional means such as threadings or retainer springs or the like.

BRIEF DESCRIPTION OF THE DRAWINGS

In order that the invention may be clearly understood, it will now be described by way of example with reference to the accompanying drawings, wherein.

DETAILED DESCRIPTION OF PREFERRED EXAMPLE EMBODIMENTS AND OF THE BEST MODE OF THE INVENTION

Figure 1:
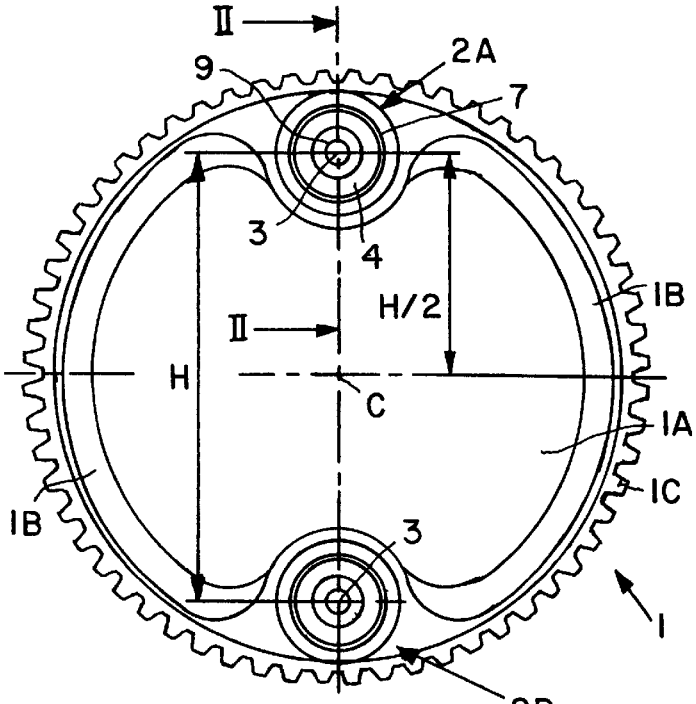
FIG. 1 shows a plan view of a leno disk equipped with two thread guides or eyelets according to the invention.

FIG. 1 shows a leno device including a leno member such as a disk or ring of a selvedge rotor in a loom as, for example, disclosed in the above-mentioned U.S. Pat. No. 5,524,678 (Haüssler et al.). The disclosure of the just mentioned U.S. Patent is incorporated herein by reference.

The leno ring 1 shown in FIG. 1 carries two thread guide eyelets or thread guides 2A and 2B of identical construction. Each eyelet 2A, 2B has its own central guide axis 3. The two thread guides or eyelets 2A, 2B are arranged diametrically opposite each other relative to a center axis C of the leno ring 1 and mirror-symmetrically relative to the center C so that the rotational central guide axes 3 of the eyelets 2A, 2B are spaced from each other by a spacing H and from the center C by a spacing H/2. The leno ring 1 has a lightweight construction since the ring is formed by two semicircular ring ribs 1B surrounding an open central area 1A forming a through hole. The ring ribs 1B are reinforcing rib sections that carry the two eyelets 2A and 2B in rib junction areas as shown in FIG. 1. These eyelets are secured to the leno disk 1 by any conventional connecting elements, whereby the connection may either rigidly secure the eyelets to the leno disk or permit the rotation of the eyelets about their respective central rotational guide axis 3. In an alternative embodiment the eyelets 2A and 2B may be machined directly into an enlarged portion of the ribs 1B. However, the rotational mounting of individual eyelets 2A, 2B may be preferred because it reduces friction between the threads passing through the eyelet and the surface areas of the eyelet in contact with the thread. Further, individually and removably mounted eyelets can easily be replaced when wear and tear calls for such replacement. Spring rings or the like could, for example be used for the removable mounting. In a preferred embodiment the rim of the leno disk or ring is a gear rim 1C.

Figure 2:
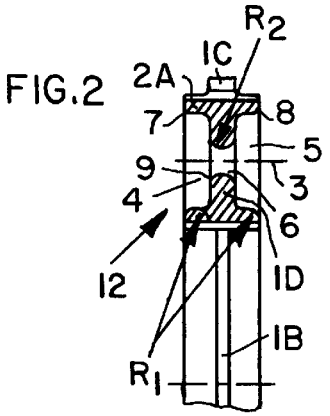
FIG. 2 is a sectional view along section line II—II in FIG. 1 to show details of the present thread guide eyelets.

Referring to FIG. 2, the ring construction results in a lightweight leno ring 1 which is further enhanced by providing each eyelet 2A, 2B, with two axially facing recesses 4 and 5. The recess 4 is surrounded by an eyelet rim portion 7. The recess 5 is surrounded by an eyelet rim portion 8.

Figure 5:
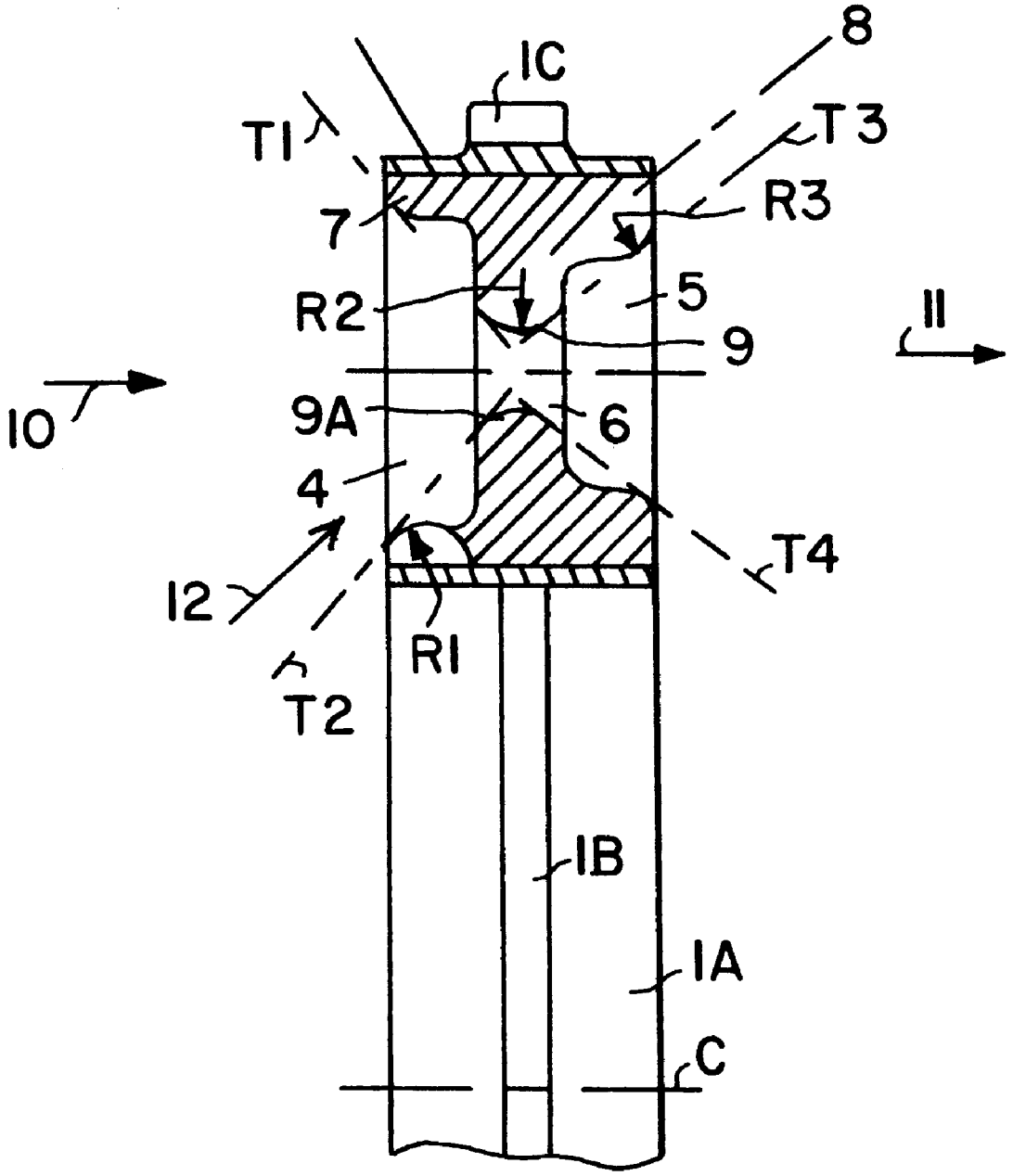
FIG. 5 is a view, on an enlarged scale, similar to FIG. 4 but illustrating an entrance opening angle $\alpha$ larger than the exit opening angle $\beta$.

Each eyelet rim portion 7 and 8 of the thread guide eyelets 2A, 2B forms a curved ring surface which has a radius R1 of curvature as shown in FIG. 2. In the alternative, the curvature of the curved ring surfaces may have different radii R1 and R3 as shown in FIG. 5.

Each thread guide eyelet 2A, 2B has a central eyelet section 1D provided with a thread guide hole 6 surrounded by an edge or bead 9 forming a curved ring surface having its own radius of curvature R2. Preferably, but not necessarily, the thread guide hole 6 is centered relative to the guide axis 3 of the respective guide eyelet 2A, 2B.

Figure 3:
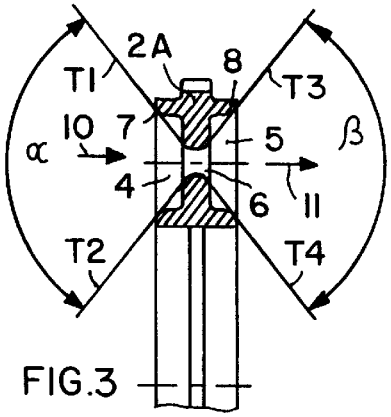
FIG. 3 is a view similar to that of FIG. 2 showing additionally the formation of an entrance with an opening angle $\alpha$ and an exit with an opening angle $\beta$ of an eyelet according to the invention.

Referring to FIG. 3, each of the recesses 4 and 5 has a diameter defined by its respective eyelet rim portion 7 or 8. In FIG. 3 these diameters are equal to each other.

Two tangential lines T1 and T2 define an entrance illustrated symbolically by an arrow 10. Two further tangential lines T3 and T4 define an exit symbolized by an arrow 11. The tangential lines T1 and T2 enclose an opening angle $\alpha$ of the entrance 10. The tangential lines T3 and T4 define an opening angle $\beta$ of the exit 11. The tangential lines contact the respective curvatures of the ring surfaces formed by the curvature having the radius R1 and R2. For example, the line T1 contacts the curvature of the eyelet rim portion 7 and a portion of the curved ring surface of the edge 9 around the thread guide hole 6. The other tangential lines are similarly defined. A leno thread 12 shown in FIG. 2 travels approximately along the tangential line T2 into the guide and along the tangential line T3 out of the guide.

Figure 4:
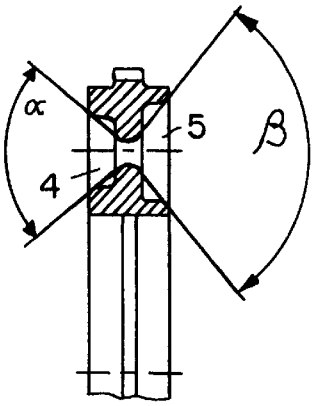
FIG. 4 illustrates an embodiment wherein the entrance opening angle $\alpha$ is smaller than the exit opening angle $\beta$.

The size of the opening angles $\alpha$ and $\beta$ will depend on the diameter of the recesses 4 and 5. Thus, in FIG. 4 the diameter of the recess 4 is smaller than the diameter of the recess 5, whereby the opening angle $\alpha$ of the entrance 10 is smaller than the opening angle $\beta$ of the exit 11. The selection of these angles will depend on the direction in which the leno thread or threads must travel for properly forming the required leno shed configuration.

In FIG. 5 the diameter of the recess 4 is larger than the diameter of the recess 5, whereby the angle $\alpha$ becomes larger than the angle $\beta$.

When a leno thread 12 travels into the entrance 10, the thread will contact a small surface area of the eyelet rim portion 7 having the curvature R1. The thread will then continue to move along tangential line T2 into the eyelet without contacting any further part of the eyelet until the thread contacts a portion 9A of the curvature of the edge or bead 9. As the thread continues to travel through the thread guide hole 6, the leading end portion of the thread will be out of contact with the edge or bead 9 until the thread contacts a small surface area portion of the edge or bead 9 facing toward the exit 5. As the thread continues to travel, it's leading end will again be out of contact between the just mentioned portion of the edge or bead 9 and the curvature of the ring surface formed by the radius R3. Thus, the thread contacts four small surface areas of the eyelet while travelling through the eyelet, whereby friction between the eyelet surfaces and the thread 12 is substantially reduced because these contact surface areas are curved by the curvatures having the radii R1 or R3 and R2, while still providing a positive guidance of the thread travelling from a supply spool not shown through the leno to form the leno shed.

The radii R1, R2 and R3 are selected so that an optimal friction reduction is achieved while still assuring the required positive guidance of the leno thread. Further, the just mentioned radii are so selected that even delicate threads can pass along these radii with the required gentle treatment that is even suitable for using glass silk threads for the leno selvage formation.

Wear and tear is reduced and a friction reducing surface is provided especially if the eyelets 2A, 2B are chromium hard plated or made of ceramic material. At least those areas are hard plated or made of ceramics where the contact between the thread and the eyelet takes place.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A leno device for a weaving loom, said leno device comprising a leno member (1) and at least one thread guide eyelet (2A, 2B) mounted in said leno member (1), said thread guide eyelet (2A, 2B) comprising a central eyelet section (1D) and an eyelet rim surrounding said central eyelet section (1D), said eyelet rim including a first rim portion (7) projecting from said central eyelet section in one axial direction to surround a first recess (4) on one side of said central eyelet section (1D); said eyelet rim further including a second rim portion (8) projecting from said central eyelet section (1D) in the opposite axial direction to surround a second recess (5) on an opposite side of said central eyelet section (1D), said first rim portion (7) having a first curvature (R1) forming a first curved ring surface for contacting a leno thread passing into said leno device, a thread guide hole (6) through said central eyelet section (1D), a thread guide bead (9) surrounding said thread guide hole (6), said thread guide bead (9) having a second curvature (R2) forming a second curved ring surface for contacting said leno thread passing through said thread guide hole (6), said second rim portion (8) having a third curvature (R3) forming a third ring surface for contacting said leno thread passing out of said thread guide hole (6), wherein said first recess (4) separates said first curved ring surface from said second curved ring surface, and wherein said second recess (5) separates said third ring surface from said second ring surface so that said leno thread contacts said first and second ring surfaces on its way through an entrance (10) into said thread guide eyelet and said second and third ring surfaces on its way through an exit (11) out of said thread guide eyelet, whereby a friction contact area between said leno thread and said curved ring surfaces is reduced by said recesses (4, 5) and a positive thread guiding is enforced by said first, second and third ring surfaces.

2. The leno device of claim 1, wherein said first recess (4) and said second recess (5) have equal diameters so that an opening angle (α) of said entrance (10) and an opening angle (β) of said exit (11) are equal to each other.

3. The leno device of claim 1, wherein said first recess (4) has a diameter smaller than a diameter of said second recess (5) so that an opening angle (α) of said entrance (10) is also smaller than an opening angle (β) of said exit (11).

4. The leno device of claim 1, wherein said first recess (4) has a diameter larger than a diameter of said second recess (5) so that an opening angle (α) of said entrance (10) is larger than an opening angle (β) of said exit (11).

5. The leno device of claim 1, wherein said entrance (10) has an opening angle (α) and said exit (11) has an opening angle (β) and wherein said angles (α) and (β) are larger than or equal to 90°.

6. The leno device of claim 1, wherein said thread guide eyelet (2A, 2B) with its rim portions (7, 8) is a structural component separate from said leno member (1), said separate structural component being mounted in said leno member (1).

7. The leno device of claim 1, wherein said thread guide eyelet (2A, 2B) is mounted in said leno member (1) for rotation relative to said leno member (1).

8. The leno device of claim 1, wherein said thread guide eyelet (2A, 2B) is rigidly mounted in said leno member (1).

9. The leno device of claim 1, wherein said thread guide eyelet (2A, 2B) comprises wear resistant surfaces for contacting said leno thread.

10. The leno device of claim 9, wherein said wear resistant surfaces of said thread guide eyelet comprise a hard chromium coating.

11. The leno device of claim 1, wherein at least part of said thread guide eyelet and of said first and second rim portions (7 and 8) is made of ceramic material.

12. The leno device of claim 1, wherein said thread guide eyelet with said thread guide hole (6) and said first and second rim portions (7, 8) are an integral part of said leno member (1).

13. The leno device of claim 1, wherein said thread guide hole (6) of said thread guide eyelet passes concentrically through said thread guide eyelet.

14. A leno device for a weaving loom, said leno device comprising a leno member (1) and at least one thread guide eyelet (2A) in said leno member (1), a rim surrounding said thread guide eyelet, said rim having first and second rim portions (7, 8) axially projecting in opposite axial directions from said thread guide eyelet, a thread guide hole (6) through said thread guide eyelet, each of said rim portions (7, 8) having a first curvature with a first radius (R1) forming a thread entrance (10) into said thread guide hole (6) and a thread exit (11) out of said thread guide hole (6), a bead (9) surrounding said thread guide hole (6), said bead (9) having a second curvature with a second radius (R2), and wherein at least two tangential lines (T1, T2; T3, T4) contacting said first and second curvatures enclose an opening angle (α) of said thread entrance (10) and an opening angle (β) of said thread exit (11) for positively guiding a thread through said thread guide with an optimally small friction contact surface area between said thread and said first and second curvatures.

15. The leno device of claim 14, wherein said at least one thread guide eyelet (2A) is rotatably mounted in said leno member (1).

16. The leno device of claim 14, wherein said at least one thread guide eyelet is rigidly mounted in said leno member (1).

17. The leno device of claim 14, wherein said at least one thread guide eyelet is an integral part of said leno member (1).

18. The leno device of claim 14, wherein said thread guide eyelet has a central axis (3), and wherein said thread guide hole (6) is positioned coaxially with said central axis (3).

19. The leno device of claim 14, wherein said opening angles (α) and (β) are equal or unequal relative to each other.

20. A leno device for a weaving loom, said leno device comprising a leno ring (1) and first and second thread guide eyelets (2A, 2B) identical to each other, wherein said first and second thread guide eyelets (2A, 2B) are positioned mirror-symmetrically and diametrically opposite each other relative to a rotation axis (C) of said leno ring (1), wherein said leno ring (1) comprises circular reinforcing rib sections (1B) surrounding a central opening (1A) of said leno ring (1), and wherein said first and second thread guide eyelets (2A, 2B) are held in place by said circular reinforcing rib sections (1B).

21. The leno device of claim 20, wherein said first and second thread guide eyelets (2A, 2B) are rotatably mounted in junction areas between said circular reinforcing rib sections (1B).

* * * * *